United States Patent [19]

Yasujima et al.

[11] 4,073,971

[45] Feb. 14, 1978

[54] PROCESS OF MANUFACTURING TERMINALS OF A HEAT-PROOF METALLIC THIN FILM RESISTOR

[76] Inventors: Nobuo Yasujima, 1-4, Noda, Kawagoe,, Saitama; Juichiro Arai, 1-5-3 Kaganchara,, Chiba-Matsudo; Natsuo Itokawa, 23 Kamitotsuka,, Fujioka, Gunma; Katsumoto Okino, 125 Kuroda,, Mamba, Tano, Gumma, all of Japan

[21] Appl. No.: 692,229

[22] Filed: June 2, 1976

Related U.S. Application Data

[63] Continuation of Ser. No. 491,940, July 25, 1974, abandoned.

[30] Foreign Application Priority Data

July 31, 1973 Japan ..... 48-85436
July 10, 1974 Japan ..... 49-78849

[51] Int. Cl.[2] ..... B05D 5/12; H01B 1/02; H01C 17/28

[52] U.S. Cl. ..... 427/103; 29/621; 252/513; 338/307; 427/103; 427/294; 427/350; 427/377; 427/383 C; 428/457; 428/662; 428/663; 428/929; 428/936

[58] Field of Search ..... 427/101-103, 427/294, 377, 350, 383 A; 29/621; 338/307; 252/513; 428/209, 457, 662, 663, 929, 936

[56] References Cited

U.S. PATENT DOCUMENTS

| | | | |
|---|---|---|---|
| 3,172,074 | 3/1965 | Drewes et al. | 427/101 |
| 3,496,512 | 2/1970 | Matsuoka | 29/621 |
| 3,546,015 | 12/1970 | Vulliez et al. | 427/101 |
| 3,607,386 | 9/1971 | Gulla et al. | 427/102 |
| 3,904,461 | 9/1975 | Estep et al. | 427/102 |
| 3,930,896 | 1/1976 | Takahama | 427/101 |
| 3,934,058 | 1/1976 | Seebacher | 427/103 |

*Primary Examiner*—Thomas J. Herbert, Jr.
*Assistant Examiner*—R. Eugene Varndell, Jr.

[57] ABSTRACT

A process for making thin film resistor terminals is described. Terminal fabrication is accomplished by the steps of chemical plating onto the terminal forming surfaces of the resistor and thereafter heat treating between 300° and 800° C in the vacuum, non-oxidation gas or non-oxidation atmosphere or in the air, oxidation gas or oxidation atmosphere. The chemical plating is of nickel, cobalt or nickel-cobalt alloy.

8 Claims, 6 Drawing Figures

PROCESS OF MANUFACTURING TERMINALS OF A HEAT-PROOF METALLIC THIN FILM RESISTOR

This is a continuation, of application Ser. No. 491,940, filed July 25, 1974, now abandoned.

BACKGROUND OF THE INVENTION

The present invention relates to a process of manufacturing terminals of a heat-proof metalic thin film resistor.

In the past, as to the metallic thin film resistor, a kind of nichrome system was generally used and a tantalum nitride was employed for the requirement of high reliability.

These terminals are, as well known, of a thin film double layer structure such as nichrome-gold.

In the case that with the tantalum nitride or the like employed the heat treatment is required, an intermediate layer of a platina group is sandwiched to form a triple layer structure such as nichrome (or titanium)-palladium-gold to prevent the diffusion of the gold into the metallic thin film resistor.

These prior arts have necessarily incurred a rise in manufacturing cost due to the evaporation of a plurality of metals, etching and employment of expensive materials.

SUMMARY OF THE INVENTION

The invention is intended for eliminating the above mentioned shortcoming of prior arts.

According to the invention, a process for manufacturing terminals of a heat-proof metallic thin film resistor can be obtained wherein the process comprises the steps of chemical plating onto the terminal forming surfaces of the resistor and thereafter heat treating between 300° and 800° C in the vacuum, non-oxidation gas or non-oxidation atmosphere or in the air, oxidation gas or oxidation atmosphere. The chemical plating used therein is of nickel, cobalt or nickel-cobalt alloy.

An object of the invention is to provide a new and novel method for fabricating heat-proof metallic thin film resistor terminals, which method can facilitate to remarkably minimize the contact resistance and to easily and inexpensively accomplish the stable connection as well as the decrease in current noise.

Other objects and advantages will be apparent from the following description of preferred embodiments thereof when taken in conjunction with the accompanying drawings.

DETAILED DESCRIPTION OF THE PREFERRED EMBODIMENT

Figure 1:
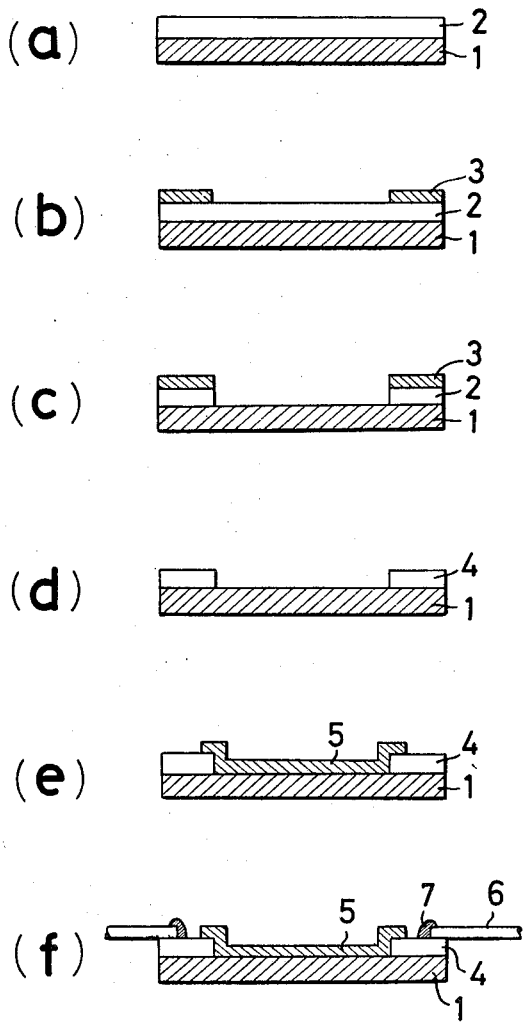
FIG. 1 is a sectional view of a heat-proof metallic thin film resistor illustrating the steps of forming terminals according to one embodiment of this invention.

FIG. 1 is a sectional view illustrating the steps of one embodiment according to this invention and, first, as shown in FIG. 1(*a*) a chemical plating is applied onto the overall surface of a flat plate shaped substrate 1 to form a chemical plating layer 2. The chemical plating employed therein is of nickel, cobalt or nickel-cobalt alloy.

In the second step, as shown in FIG. 1(*b*), a resist coating material 3 is coated onto the terminal forming surface of the chemical plating layer 2 and thereafter the etching is applied to be formed as shown in FIG. 1(*c*).

Next, the resist coating material 3 is removed to complete the terminals 4 as shown in FIG. 1 (*d*).

Since in the case of this embodiment a heat-proof metallic thin film resistor is not yet provided, a suitable mask is overlaid in position and an evaporation, sputtering or some other is applied to form a heat-proof metallic thin film resistor 5 as shown in FIG. 1(*e*). Then, the same is heat treated by heating at a temperature between 300° and 800° C for 10 minutes in the vacuum, non-oxidation gas or non-oxidation atmosphere or in the air, oxidation gas or oxidation atmosphere.

Finally, as shown in FIG. 1(*f*), a lead wire 6 is fixed by the solder 7 to the terminal 4.

In this occasion, in case of heating over 450° C in the oxidation atmosphere, the lead wire fixing must be accomplished after removing the oxide film of the terminal metal.

Figure 2:
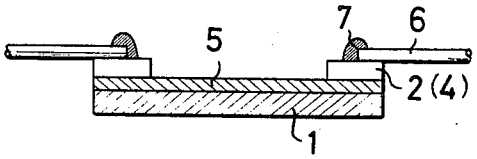
FIGS. 2 through 4 are sectional views of the resistors illustrating respectively other embodiments according to this invention.

FIG. 2 illustrates another embodiment of the invention. In this embodiment, a heat-proof metallic thin film resistor 5 is first formed onto the flat plate shaped substrate 1 and thereafter a chemical plating layer 2 is provided in a same manner at the both ends and same heat-treating is applied to complete terminals 4.

Figure 3:
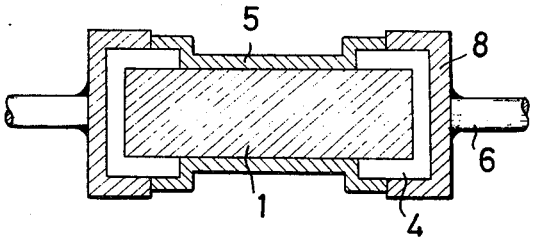

FIG. 3 is, in place of the flat plate shaped substrate 1 of FIG. 1, an embodiment that uses a cylindrical substrate 1 wherein all of the terminals 4, heat-proof metallic thin film resistor 5 and other are formed along the outer circumferential surface of the substrate 1. In the drawing, reference numeral 8 is a metal cap.

Figure 4:
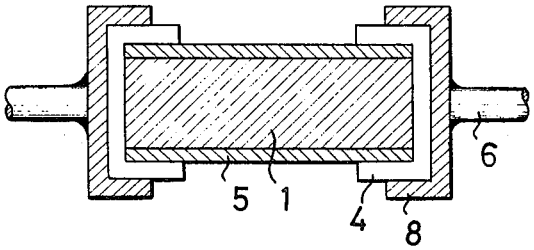

FIG. 4 is, in place of the flat plate shaped substrate 1 of FIG. 2, an embodiment that uses a cylindrical substrate 1 wherein it is accomplished in a substantially same manner as the embodiment of FIG. 3.

Though, with the embodiments illustrated in FIGS. 1 and 2, in case of heating over 450° C in the oxidation atmosphere, the lead wire fixing must be accomplished after removing the oxide film of the terminal metal, it is unnecessary to previously remove this oxide film in case of press-fitting the metal cap 8 onto the cylindrical substrate 1 as shown in the embodiments FIGS. 3 and 4 because the oxide film may be breaked due to the press-fitting.

As the heat-proof metallic thin film resistor 5 in the above mentioned embodiments, it may use a composition comprising boride of tantolum nitride, beta tantalum, tantalum, tungsten, molybdenum, zircon, titanium, niobium and other; binary alloy such as tantalum-silicon, molybdenum-silicon, tungsten-silicon and aluminium-silicon;or ternary alloy containing said binary alloy (excluding tantalum-silicon) and tantalum. However, when the one exclusive of tantalum-silicon is heated over 400° C in the air, the heating period must be adjusted in accordance with the film thickness because of its remarkable growth of the oxide film.

The following is a description of the functions and effects or advantages resulting from the present invention.

Table I shows a comparison in electric current noise of the tantalum-silicon alloy thin film resistor of 1000 ohm/sq and 6 in ratio of rectangle having the terminals formed according to this invention with that of other terminal formation.

As is apparent from Table I, the sample of the conductive adhesives based mainly on a corpuscular contact is most inferior in performance while the sample subjected to apply the chemical plating followed by heat treating shows a most superior value.

On the one hand the conductive adhesives will be unable to subject the heat treatment after the terminal lead fixing and on the other hand the nichrome-gold has a shortcoming that will disturb the characteristics of the resistor due to the diffusion of the gold into the heat-proof metallic thin film resistor.

Therefore, as a practical terminal able to bear up against the heat treatment, there is nothing but by relying upon either the aforesaid triple layer structure in which the diffusion preventing layer of platina group is sandwiched or the present invention.

As seen from this Table I, the terminals subjected to nickel chemical plating remarkably minimize the electric current noise by the subsequent heat treating.

It is presumed that at the interface between the heat-proof metallic thin film resistor and terminal metal the mutual diffusion may occure so as to have been alloyed.

Table I (0 dB = 1 micro V/V)

| sample preparation manner | current noise (dB) |
|---|---|
| terminal lead fixed by conductive adhesives | +11 |
| evaporating of nichrome-gold | −20 |
| applying of nickel chemical plating | −19 |
| after treating, terminal lead fixed by conductive adhesives | +45 |
| heat treating followed by evaporating of nichrome-gold | 0 |
| heat treating followed by applying of nickel chemical plating | +3 |
| nickel chemical plating followed by heat treating | −27 |

Figure 5:
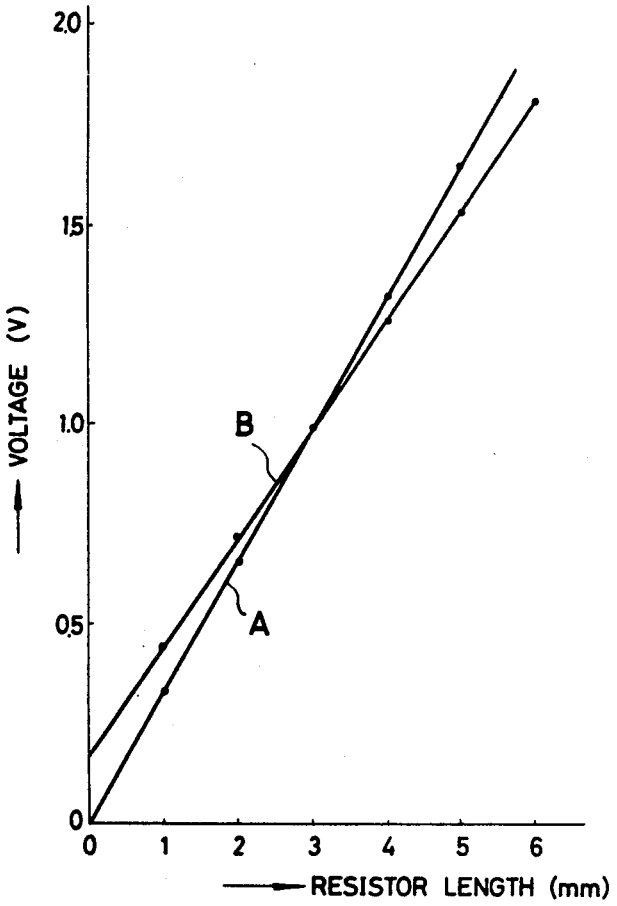
FIG. 5 is a graph illustrating the contact resistance at terminals according to this invention measured by the potential difference method.

FIG. 5 shows a comparison of the contact resistance measured by the potential difference method of the heat-proof thin film resistor heat-treated at 500° C in which the terminal lead is fixed by the conductive adhesives (Line B) with the heat-proof thin film resistor subjected to apply the nickel chemical plating followed by the heat treatment at 500° C in the vacuum in which the terminals are formed according to this invention (Line A).

In either case, such heat-proof thin film resistor is of a tantalum-silicon alloy with its area resistance of about 1000 ohm/sq and 6 in ratio of rectangle. With DC 2 V impressed between the both terminals, the potential difference is measured with respect to the resistor length.

The case in which the lead wires are fixed by the conductive adhesives as shown in Line B proves the existence of the potential difference of 0.16 V at both terminal portions, i.e. contact resistance of 8 % at each terminal portion with respect to the overall resistance value.

On the contrary, the case in which the terminals are subjected to apply the nickel chemical plating as shown in Line A proves that the potential difference at the terminal portions is so small that it is almost unable to measure and thus the contact resistance is actually zero.

Therefore, according to this invention the contact resistance resulting in exersion of the current noise as well as change of the resistance value is removed so as to improve the characteristics.

Figure 6:
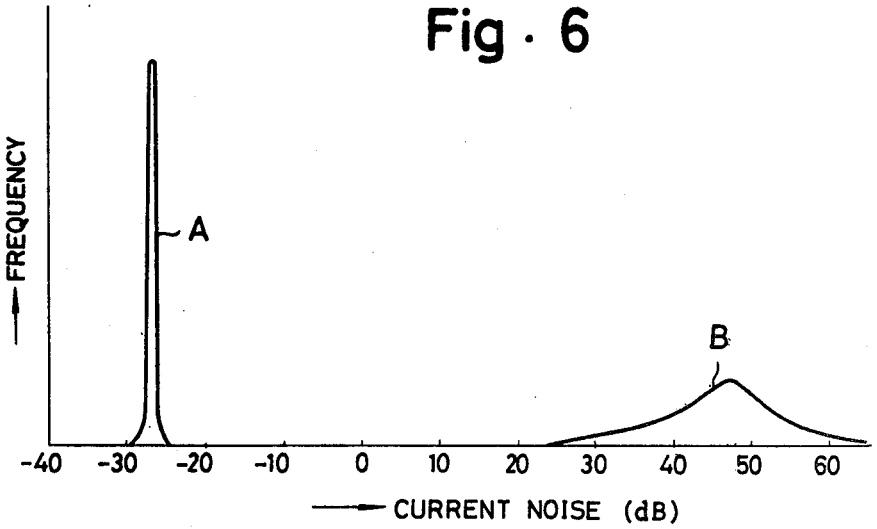
FIG. 6 is a graph illustrating the frequency distribution in current noise of the sample used in FIG. 5.

FIG. 6 shows a freqeuncy distribution in electric current noise of the above-noted sample.

It is understood that the Curve B which is the case having terminals fixing the lead wire by the conductive adhesives is extremely high in current noise level and varies widely in its dispersion compared with Curve A which is the case having terminals subjected to apply the nickel chemical plating followed by the heat treatment according to this invention.

In case of the resistors of cylindrical substrates as shown in FIGS. 3 and 4 since the thin oxide film on the resistor can be breaked by the press-fitting of the cap 8 without applying the chemical plating it is able to maintain a good contact in comparison with the case of the flat plate shaped resistor with its lead wire fixed by the conductive adhesives, but it is recognized that there is a remarkable difference in the stablity of the connection as well as current noise and the like in comparison with the one subjected to apply the chemical plating followed by heat treating.

This comparison is shown in Table II. In this table, the sample is a heat-proof thin film resistor of 1000 ohm/sq, 6 in ratio of rectangle and heat-treated at 500° C in the vacuum.

Table II

| item of test | heat-treated resistor to which the cap is directly press-fitted | resistor subjected to apply nickel chemical plating followed by heat treating to which the cap is press-fitted |
|---|---|---|
| current noise (dB) | −14 to +10.0 | below −20 |
| solder immersion test (on the authority of Japanese Industrial Standard) (% in change of resistance) | 0.2 to 0.9 | below 0.05 |

The above-noted heat treating effect of the chemical plating terminal according to this invention can not be recognized in case of a temperature below 300° C.

Besides, in case of a temperature exceeding over 800° C in the non -oxidation atmosphere such as vacuum or non-oxidation gas or some other or the oxidation atmosphere such as the air or the like, the change in quality will occur.

As above explained in detail, the present invention enables, by applying chemical plating to a heat-proof metallic thin film resistor and subsequently applying heat treating to the same at a temperature between 300° and 800° C in non-oxidation atmosphere or oxidation atmosphere, to remarkably minimize the current noise as well as contact resistance and has an advantage in which the resistor superior in electric characteristic stability can manufactured in inexpensive cost and thus its utility value is extremely great.

It is, of course, understood that modifications may be made in the foregoing embodiment without departing from the scope of the invention as set forth in the appended claims.

What we claim is:

1. A process of manufacturing terminals of a resistor consisting essentially of the steps:
   (a) depositing a resistive metallic thin film heat proof between 300° and 800° C onto a substrate,
   (b) chemical plating a metallic layer selected from the group consisting of nickel, cobalt and nickel-cobalt alloy onto terminal portions of said resistor of said resistive metallic thin film to make metallic terminal layers, and
   (c) heat treating the resultant resistor at a temperature between 300° and 800° C in a non-oxidation atmosphere whereby said terminal layers which contact with said resistive metallic thin film reduce contact resistance therebetween to substantially zero and thereby produce an electrical current noise of the resultant resistor below −20(db).

2. A heat-proof metallic thin film resistor with terminals manufactured according to the process as set forth in claim 1.

3. A process of manufacturing terminals of resistor consisting essentially of the steps:
   (a) depositing a resistive metallic thin film heat proof between 300° and 800° C onto a substrate,
   (b) chemical plating a metallic layer selected from the group consisting of nickel, cobalt and nickel-cobalt alloy onto terminal portions of said resistor of said resistive metallic thin film to make metallic terminal layers, and
   (c) heat treating the resultant resistor at a temperature between 300° and 800° C in an oxidation atmosphere whereby said terminal layers which contact with said resistive metallic thin film reduce contact resistance therebetween to substantially zero and thereby produce an electrical current noise of the resultant resistor below −20(db).

4. A heat-proof metallic thin film resistor with terminals manufactured according to the process as set forth in claim 3.

5. A process of manufacturing terminals of a resistor consisting essentially of the steps:
   (a) despositing a resistive metallic thin film heat proof between 300° and 800° C onto a substrate,
   (b) chemical plating a metallic layer selected from the group consisting of nickel, cobalt and nickel-cobalt alloy onto said resistive metallic thin film
   (c) coating a resistive coating material onto the metallic layer,
   (d) removing the resistive coating material except terminal portions of said resistor to expose said metallic layer,
   (e) etching the exposed metallic layer to expose the resistive metallic thin film,
   (f) removing the resistive coating material which has been coated onto said terminal portions of the resistor to expose the metallic layer which acts as terminal layers of said resistor, and
   (g) heat treating the resultant resistor at a temperature between 300° and 800° C in a non-oxidation atmosphere whereby said terminal layers which contact with said resistive metallic thin film reduce contact resistance therebetween to substantially zero and thereby produce an electrical current noise of the resultant resistor below −20(db).

6. A process as set forth in claim 5, wherein the heat-proof resistive metallic thin film essentially consists of tantalum-silicon.

7. A process of manufacturing terminals of a resistor consisting essentially of the steps:
   (a) depositing a resistive metallic thin film heat proof between 300° and 800° C onto a substrate,
   (b) chemical plating a metallic layer selected from the group consisting of nickel, cobalt and nickel-cobalt alloy onto said resistive metallic thin film,
   (c) coating a resistive coating material onto the metallic layer,
   (d) removing the resistive coating material except terminal portions of said resistor to expose said metallic layer,
   (e) etching the exposed metallic layer to expose the resistive metallic thin film,
   (f) removing the resistive coating material which has been coated onto said terminal portions of the resistor to expose the metallic layer which acts as terminal layers of said resistor, and
   (g) heat treating the resultant resistor at a temperature between 300° and 800° C in an oxidation atmosphere whereby said terminal layers which contact with said resistive metallic thin film reduce contact resistance therebetween to substantially zero and thereby produce an electrical current noise of the resultant resistor below −20(db).

8. A process as set forth in claim 7, wherein the heat-proof resistive metallic thin film essentially consists of tantalum-silicon.

* * * * *